US009225066B2

(12) United States Patent
Chou

(10) Patent No.: US 9,225,066 B2
(45) Date of Patent: Dec. 29, 2015

(54) COUPLED FEED MICROSTRIP ANTENNA

(71) Applicant: UNICTRON TECHNOLOGIES CORP., Hsin-Chu (TW)

(72) Inventor: Chih-Shen Chou, Hsin-Chu (TW)

(73) Assignee: Unictron Technologies Corp., Hsin-Chu (TW)

( * ) Notice: Subject to any disclaimer, the term of this patent is extended or adjusted under 35 U.S.C. 154(b) by 222 days.

(21) Appl. No.: 13/968,694

(22) Filed: Aug. 16, 2013

(65) Prior Publication Data

US 2014/0203973 A1 Jul. 24, 2014

(30) Foreign Application Priority Data

Jan. 21, 2013 (TW) ..... 102201320 U

(51) Int. Cl.
*H01Q 1/38* (2006.01)
*H01Q 5/30* (2015.01)
*H01Q 9/04* (2006.01)

(52) U.S. Cl.
CPC ..... *H01Q 9/0457* (2013.01); *H01Q 1/38* (2013.01); *H01Q 5/30* (2015.01); *H01Q 9/0442* (2013.01)

(58) Field of Classification Search
None
See application file for complete search history.

(56) References Cited

U.S. PATENT DOCUMENTS

2007/0008226 A1* 1/2007 Kushihi ..... 343/700 MS
2011/0242863 A1* 10/2011 Park et al. ..... 363/126

* cited by examiner

*Primary Examiner* — Robert Karacsony
(74) *Attorney, Agent, or Firm* — Rosenberg, Klein & Lee

(57) ABSTRACT

The present invention is related to a microstrip antenna including an insulating substrate, a first conducting layer and a second conducting layer respectively located at two opposing surfaces of the insulating substrate, a non-conductive isolation zone defined in the second conducting layer, and a feed-in unit located within the con-conductive isolation zone. Thus, the non-conductive isolation zone separates the second conducting layer and the feed-in unit. During application, the feed-in unit is connected with a signal feed-in terminal, enabling the microstrip antenna to receive and transmit wireless signals. During fabrication of the microstrip antenna, it does not need to make a through hole on the insulating substrate, reducing the microstrip antenna process steps and material consumption and lowering the microstrip antenna fabrication cost.

12 Claims, 24 Drawing Sheets

COUPLED FEED MICROSTRIP ANTENNA

BACKGROUND OF THE INVENTION

1. Technical Field

The present invention relates to microstrip antenna technology and more particularly to a microstrip antenna which utilizes electromagnetic coupling to establish signal feeding and does not need to make a through hole on the insulating substrate during its fabrication, thereby reducing the microstrip antenna processing steps and material consumption and lowering the microstrip antenna manufacturing cost.

2. Description of the Prior Art

Microstrip antennas have a low profile, can be mass-produced, and can easily be integrated into active components or circuit boards. Due to the aforesaid benefits, microstrip antennas are intensively used in various wireless communication devices, such as PGS (Global Positioning System) devices or RFID (Radio Frequency Identification) devices.

Referring to FIG. 1A and FIG. 1B, a schematic top view and bottom view of a microstrip antenna according to the prior art are shown. As illustrated, this prior art microstrip antenna 10 comprises an insulating substrate 11, a first conducting layer 13, a second conducting layer 15, a feed-in zone 171, and a conducting element 173, wherein the first conducting layer 13 is located at the top surface of the insulating substrate 11, and the second conducting layer 15 is located at the bottom surface of the insulating substrate 11. The conducting element 173 penetrates through the insulating substrate 11, the first conducting layer 13 and the second conducting layer 15, and is electrically connected to the first conducting layer 13.

The first conducting layer 13 at the top surface of the insulating substrate 11 works as the radiator of the microstrip antenna 10. The second conducting layer 15 at the bottom side of the insulating substrate 11 is a ground plane. During the operation of the microstrip antenna 10, the wireless signal is received by first conducting layer 13 and passed to RF circuit through the feed-in zone 171 and the conducting element 173. At transmitting, the RF circuit sends the wireless signal through the conducting element 173 and the feed-in zone 171 to the first conducting layer 13, enabling the first conducting layer 13 to transmit the signal wirelessly into the air.

During the preparation of the microstrip antenna 10, it needs to make a through hole through the insulating substrate 11, the first conducting layer 13 and the second conducting layer 15, and then insert the conducting element 173 through the through hole to connect the conducting element 173 to the first conducting layer 13 by forming the feed-in zone 171 in the junction between the conducting element 173 and the first conducting layer 13. However, making a through hole through the insulating substrate 11, the first conducting layer 13 and the second conducting layer 15 complicates the manufacturing process of the microstrip antenna 10 and increases the manufacturing cost of the microstrip antenna 10.

SUMMARY OF THE PRESENT INVENTION

It is, therefore, the main objective of the present invention to provide a microstrip antenna, which comprises an insulating substrate, a first conducting layer and a second conducting layer respectively located at two opposite surfaces of the insulating substrate, at least one isolation zone located in the second conducting layer, and a feed-in unit located within the at least one isolation zone for the connection of a signal feed-in terminal, wherein the feed-in unit is electrically connected with the first conducting layer by means of electromagnetic coupling for enabling the microstrip antenna to receive and transmit wireless signal.

It is other objective of the present invention to provide a microstrip antenna, which can achieve wireless signal transmitting and receiving without making any through hole on the insulating substrate, thereby simplifying the microstrip antenna process steps and lowering the microstrip antenna manufacturing cost.

It is still another objective of the present invention to provide a microstrip antenna, which allows adjustment of the electromagnetic coupling amount. When increasing the height of the insulating substrate of the microstrip antenna, the area of the feed-in unit can be increased to increase the electromagnetic coupling amount, enabling the feed-in unit to establish an electric connection with the first conducting layer by electromagnetic coupling, and thus, the microstrip antenna can receive and transmit wireless signals.

It is still another objective of the present invention to provide a microstrip antenna, which works in multiple resonant frequencies that are determined by the circumference of the isolation zone within the second conducting layer or the side lengths and diagonal lengths of the first conducting layer. By means of changing the circumference of the isolation zone or the side lengths and diagonal lengths of the first conducting layer, the resonant frequencies of the microstrip antenna can be adjusted.

It is still another objective of the present invention to provide a microstrip antenna, which comprises an insulating substrate, a first conducting layer and a second conducting layer respectively located on two opposite surfaces of the insulating substrate, at least one isolation zone located in the second conducting layer, and at least one feed-in unit located in the at least one isolation zone. Further, at least one first insulating unit and/or at least one second insulating unit can be installed in the first conducting layer and/or the second conducting layer to lower the resonant frequency of the microstrip antenna without changing the size, volume or material of the microstrip antenna.

It is still another objective of the present invention to provide a microstrip antenna having a circularly polarized characteristic, which comprises an insulating substrate, a first conducting layer and a second conducting layer respectively located on two opposite surfaces of the insulating substrate, at least one isolation zone located in the second conducting layer, and at least one feed-in unit located in the at least one isolation zone, wherein the feed-in unit has at least one protruding branch. The size and shape of said protruding branch as well as the angle between said protruding branch and the rest of said feed-in unit deter nine the circular polarization characteristics of said microstrip antenna.

To achieve these and other objectives of the present invention, the present invention provides a microstrip antenna for receiving and transmitting wireless signals, comprising: an insulating substrate comprising a first surface and a second surface, the first surface and the second surface being disposed opposite to each other; at least one first conducting layer located at the first surface of the insulating substrate; at least one second conducting layer located at the second surface of the insulating substrate, each of the second conducting layer comprising at least one isolation zone, each of the isolation zone being a non-conductive area within the second conducting layer; and at least one feed-in unit which connected to a signal feeding terminal and located at the second surface of the insulating substrate and within the isolation zone of the second conducting layer, wherein the at least one isolation zone is adapted to separate the feed-in unit from the second conducting layer; and the at least one feed-in unit establishes an electric connection with the first conducting layer by electromagnetic coupling across the insulating substrate.

In one embodiment of the microstrip antenna, wherein the first conducting layer comprises at least one extension portion located at at least one peripheral side surface of the insulating substrate so that the first conducting layer extends from the first surface of the insulating substrate to the at least one peripheral side surface.

In one embodiment of the microstrip antenna, wherein the shape of the isolation zone is configured as rectangular, circular, oval, polygon, any other geometric shape, or any other geometric shape with at least one protruding branch.

In one embodiment of the microstrip antenna, wherein the at least one feed-in unit has at least a part thereof overlapped with the at least one first conducting layer across the insulating substrate.

In one embodiment of the microstrip antenna, wherein each the shape of feed-in unit is configured as rectangular, circular, oval, polygon, ring-like hollow geometric shapes, or any geometric shape.

In one embodiment of the microstrip antenna, wherein the feed-in unit comprises at least one protruding branch, the size and shape of the of the protruding branch as well as the angle between said protruding branch and the rest of said feed-in unit determine the circular polarization characteristics of said microstrip antenna.

In one embodiment of the microstrip antenna, wherein the at least one feed-in unit and the at least one second conducting layer are respectively connected to signal feeding terminal and ground terminal of a circuit board or a coaxial cable.

In one embodiment of the microstrip antenna, further comprising a first resonant frequency and a second resonant frequency, the first resonant frequency and the second resonant frequency being determined subject to side lengths and diagonal lengths of the at least one first conducting layer.

In one embodiment of the microstrip antenna, further comprising a third resonant frequency determined subject to the circumference of the at least one isolation zone.

In one embodiment of the microstrip antenna, further comprising at least one first insulating unit located in the at least one first conducting layer, the at least one first insulating unit being a non-conductive area in the at least one first conducting layer.

In one embodiment of the microstrip antenna, wherein the shape of first insulating unit is configured as circular, elliptic, rectangular, polygon, curved rectangular, curved elliptic, arch, irregular arch, geometric shape having at least three branches, X-shape, or any other geometric shape.

In one embodiment of the microstrip antenna, further comprising at least one second insulating unit located in the at least one second conducting layer, each of the second insulating unit being a non-conductive area within the second conducting layer.

In one embodiment of the microstrip antenna, wherein the shape of the second insulating unit is configured as circular, elliptic, rectangular, polygon, curved rectangular, curved elliptic, arch, irregular arch, geometric shape having at least three branches, X-shape, or any other geometric shape.

In one embodiment of the microstrip antenna, wherein the feed-in unit and the isolation zone are located at an edge or peripheral area of the second conducting layer.

Other advantages and features of the present invention will be fully understood by reference to the following description in conjunction with the accompanying drawings, in which like numerals denote like components of structure.

Figure 1A:
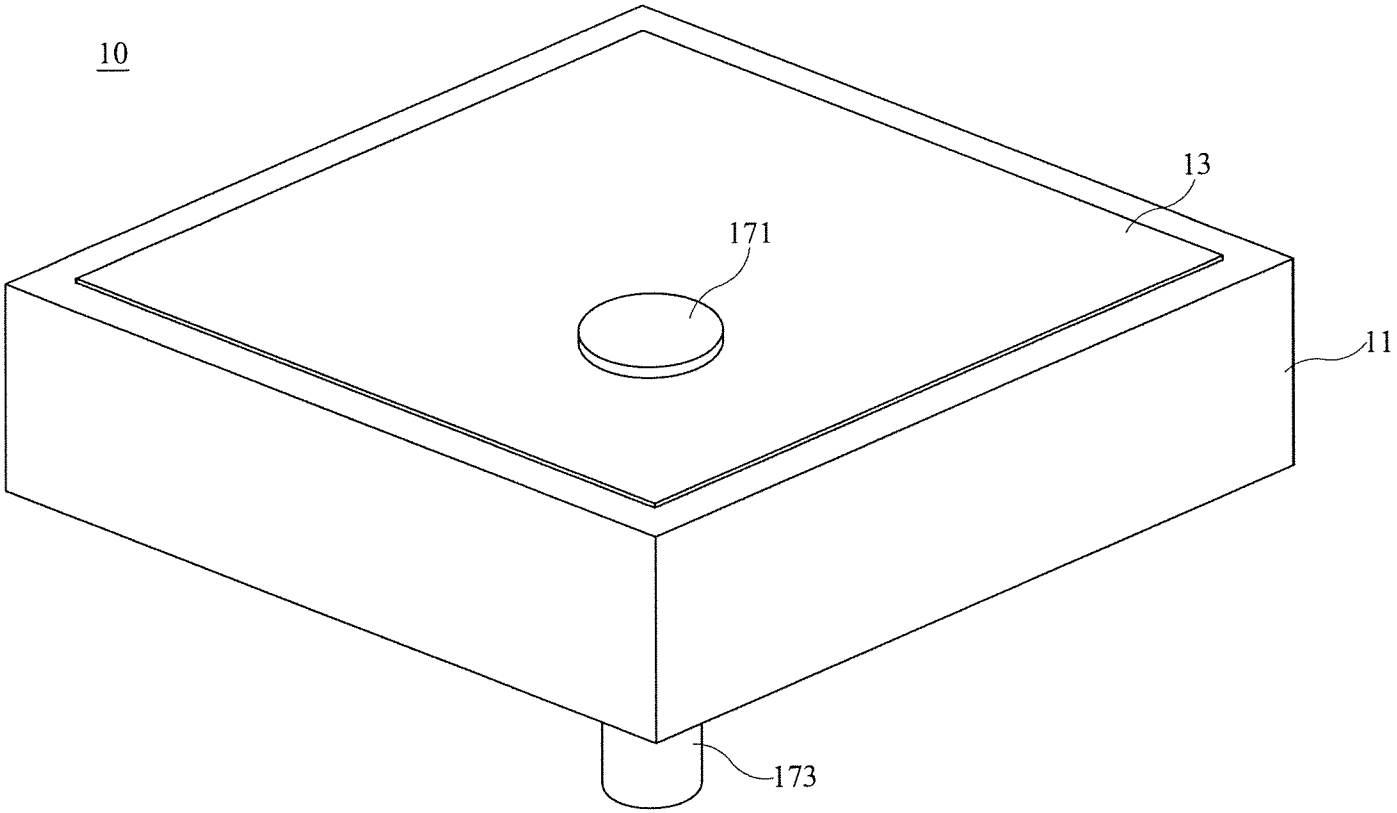
FIG.1A (PRIOR ART)
FIG. 1A is a schematic top view of a microstrip antenna according to the prior art.
Figure 1B:
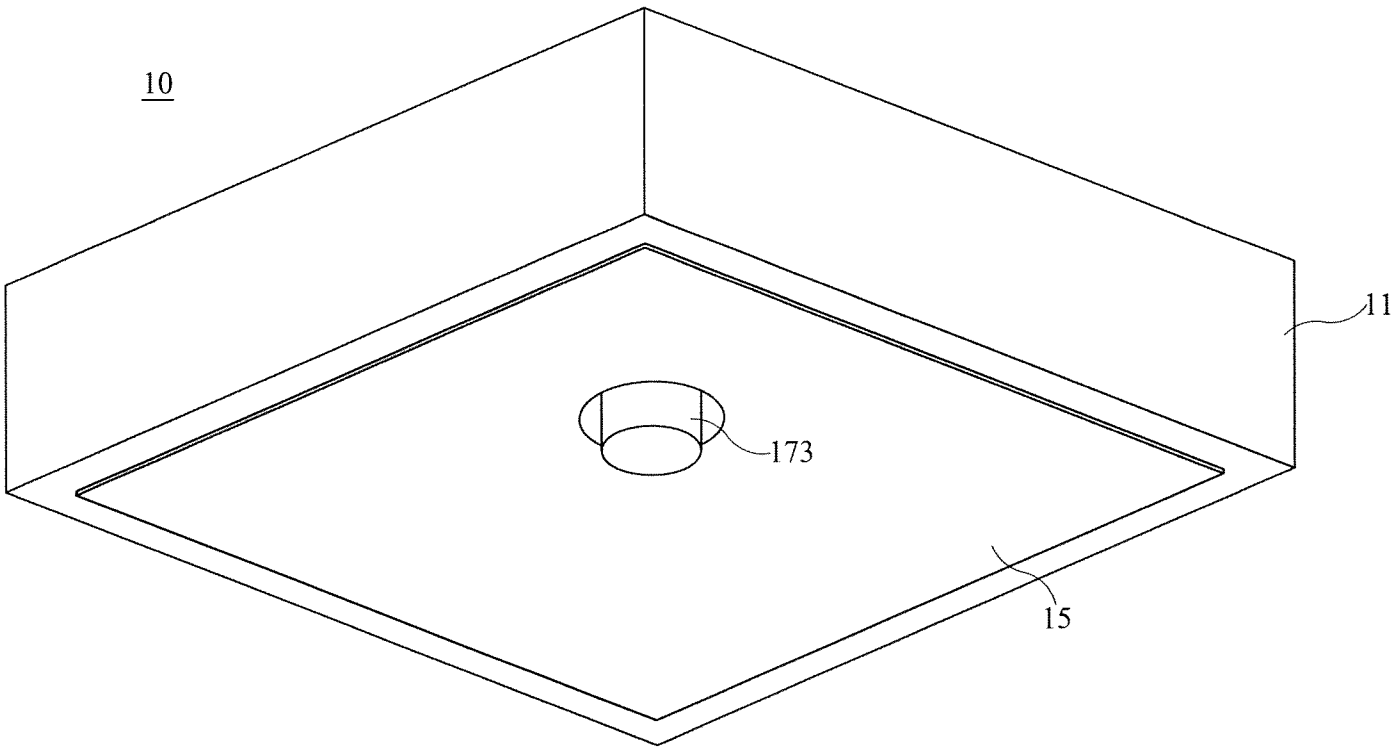
FIG.1B (PRIOR ART)
FIG. 1B is a schematic bottom view of the mierostrip antenna shown in FIG. 1.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

DETAILED DESCRIPTION OF THE PREFERRED EMBODIMENTS

In the context of this patent, the term "coupled" means either a direct connection or an indirect connection (e.g., one or more intervening connections) between one or more objects or components.

Figure 2A:
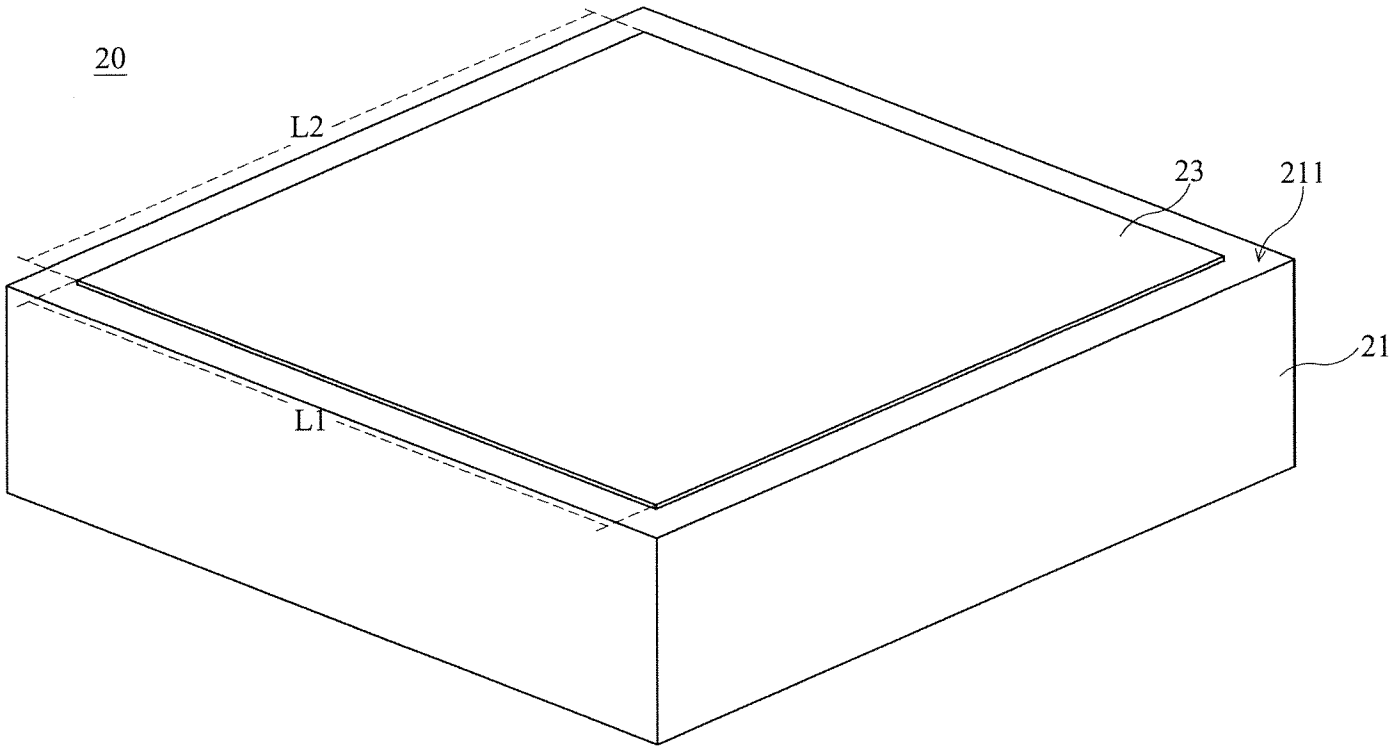
FIG. 2A is a schematic top view of a microstrip antenna in accordance with an embodiment of the present invention.
Figure 2B:
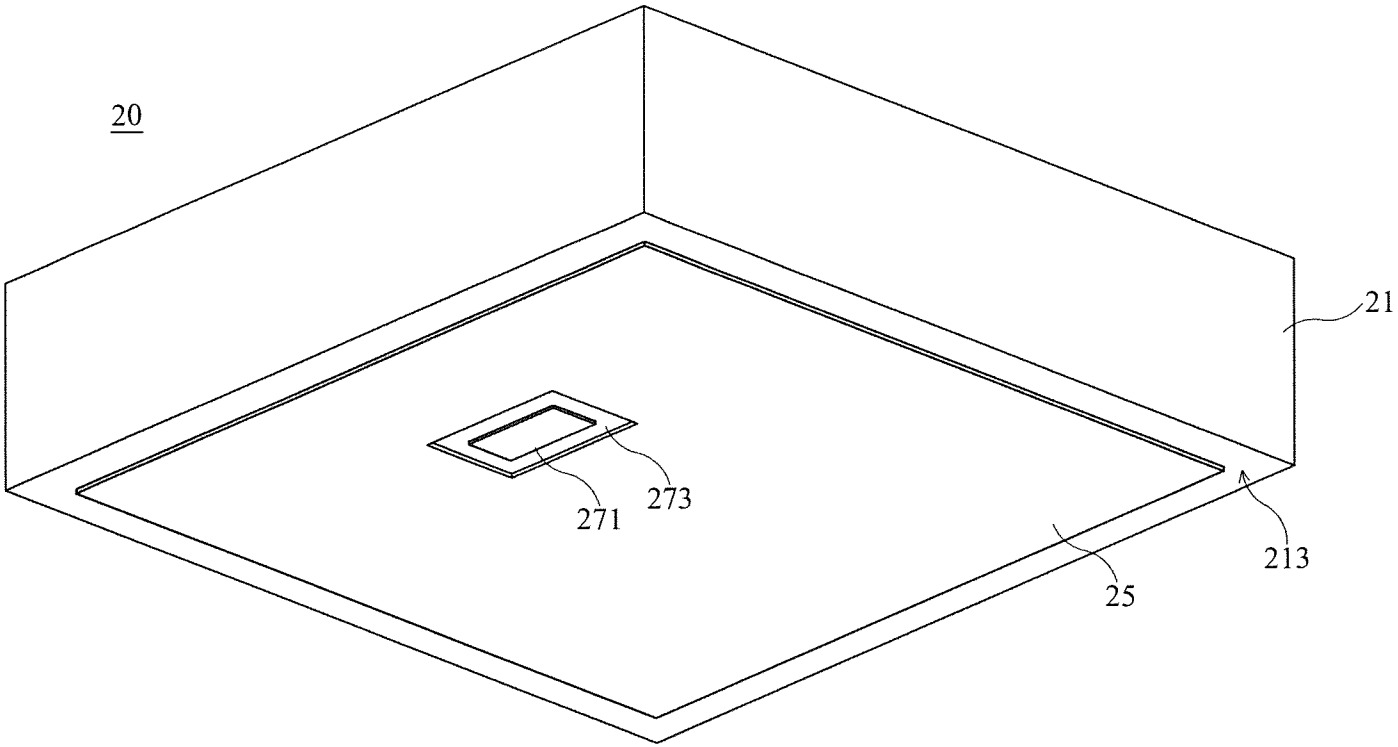
FIG. 2B is a schematic bottom view of the microstrip antenna in accordance with an embodiment of the present invention.
Figure 2C:
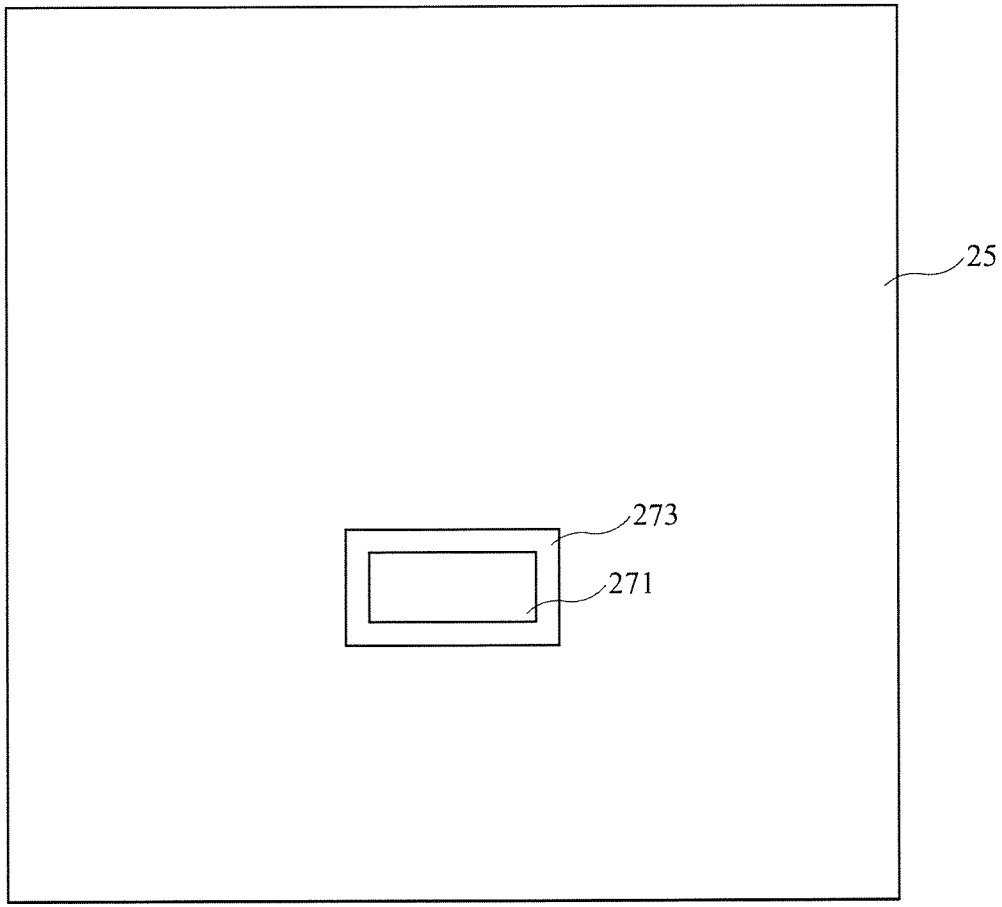
FIG. 2C is a bottom view of the microstrip antenna in accordance with an embodiment of the present invention.

Please refer to FIGS. 2A, 2B and 2C, schematic top view and bottom view of a microstrip antenna in accordance with the present invention are shown. As illustrated, the microstrip antenna 20 comprises an insulating substrate 21, at least one first conducting layer 23, at least one second conducting layer 25, at least one feed-in unit 271, and at least one isolation zone 273.

The insulating substrate 21 can be made out of a dielectric or magnetic material with a first surface 211 and a second surface 213. The first surface 211 and the second surface 213 are disposed opposite to each other, for example, the first surface 211 can be the top surface, and the second surface 213 can be the bottom surface.

In one embodiment, the first conducting layer 23 is located at the first surface 211 of the insulating substrate 21, and the second conducting layer 25 is located at the second surface 213 of the insulating substrate 21, and thus, the first conducting layer 23 and the second conducting layer 25 are disposed opposite to each other. The at least one isolation zone 273 is located at the second conducting layer 25. Further, the at least one isolation zone 273 is a region within the second conducting layer 25 that does not have any conducting material. The feed-in unit 271 is located at the second surface 213 of the insulating substrate 21 and surrounded by the at least one isolation zone 273. The at least one isolation zone 273 is adapted to separate the feed-in unit 271 from the second conducting layer 25.

The feed-in unit 271 of the microstrip antenna 20 can be electrically connected with a signal feed-in terminal for enabling the microstrip antenna 20 to transmit and receive wireless radio frequency signals. In one embodiment, the second conducting layer 25 can be electrically connected with a grounding terminal.

Subject to the principle of the electromagnetic coupling, the feed-in unit 271 of the microstrip antenna 20 can establish an electric connection with the first conducting layer 23 across the insulating substrate 21, enabling the microstrip antenna 20 to transmit and receive wireless signals. When compared to the prior art microstrip antenna 10, the microstrip antenna 20 of the present invention eliminates the necessity of the prior art microstrip antenna design of making a through hole through the insulating substrate 11, the first conducting layer 13 and the second conducting layer 15 and then inserting the conducting element 173 through the through hole on the insulating substrate 11, the first conducting layer 13 and the second conducting layer 15. Therefore, the invention simplifies the manufacturing process of the microstrip antenna 20, reduces its material consumption, and lowers its manufacturing cost.

In actual application, the dimensions of the feed-in unit 271 and the relative position relationship between the feed-in unit 271 and the first conducting layer 13 can be adjusted to change the electromagnetic coupling amount or energy. For example, the feed-in unit 271 can be partially or wholly overlapped with first conducting layer 13, or without overlapping. When the thickness of the insulating substrate 21 is increased, the lateral dimensions of the feed-in unit 271 or the superimposed area between the feed-in unit 271 and the first conducting layer 13 can be increased to increase the electromagnetic coupling energy and enable the feed-in unit 271 to establish an electric connection with the first conducting layer 13 across the insulating substrate 21 so that the microstrip antenna 20 can transmit and receive wireless signals.

In one embodiment, the microstrip antenna 20 has at least two resonant frequencies, wherein the first resonant frequency is substantially determined by the first side length L1 of the first conducting layer 23, and the second resonant frequency is substantially determined by the second side length L2 of the first conducting layer 23. In actual application, the first resonant frequency and second resonant frequency of the microstrip antenna 20 can be adjusted by changing the side lengths or the lengths of the diagonals of the first conducting layer 23.

Figure 3:
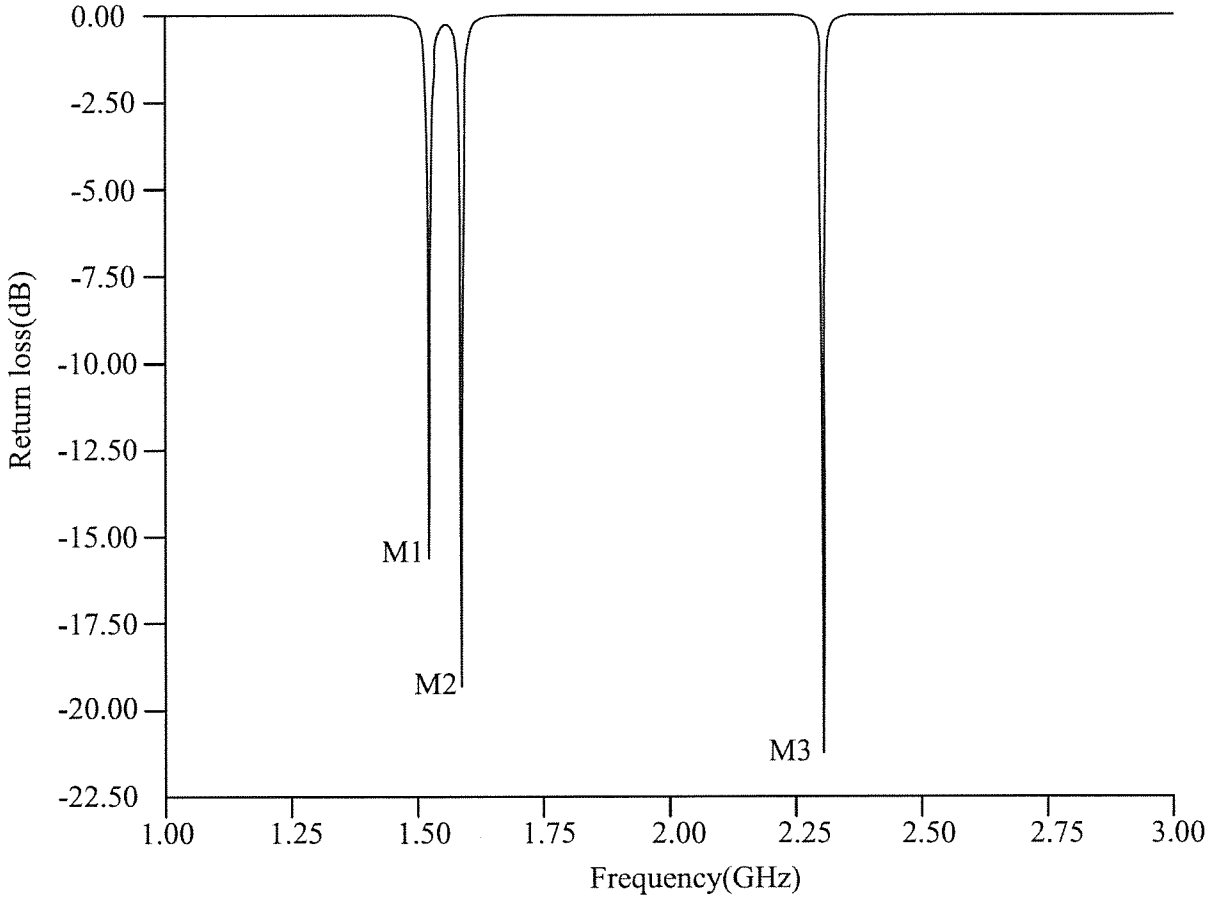
FIG. 3 is a return loss characteristic chart obtained from the microstrip antenna in accordance with an embodiment of the present invention.

In one embodiment, please refer also to FIG. 3, the first side length L1 of the first conducting layer 23 is about 30.0 mm; the second side length L2 of the first conducting layer 23 is about 29.5 mm; the first resonant frequency M1 is about 1.530 GHz, and its return loss is about −15.5 dB; the second resonant frequency M2 is about 1.590 GHz, and its return loss is about −19.2 dB. The microstrip antenna 20 can also have a third resonant frequency M3 that is substantially determined by the circumference of the isolation zone 273. In actual application, the third resonant frequency of the microstrip antenna 20 can be adjusted by means of changing the circumference of the isolation zone 273. Please refer alto to FIG. 3, in one embodiment, the total length of the circumference of the isolation zone 273 is about 26 mm, the third resonance frequency M3 is about 2.310 GHz, and the return loss is about −21.3 dB.

As stated above, the microstrip antenna 20 can work in multiple resonant frequencies. By means of changing the circumference of the isolation zone 273 and the lengths of the sides and diagonals of the first conducting layer 23 to adjust the resonant frequencies of the microstrip antenna 20, the application range of the microstrip antenna 20 is widened.

Figure 4:
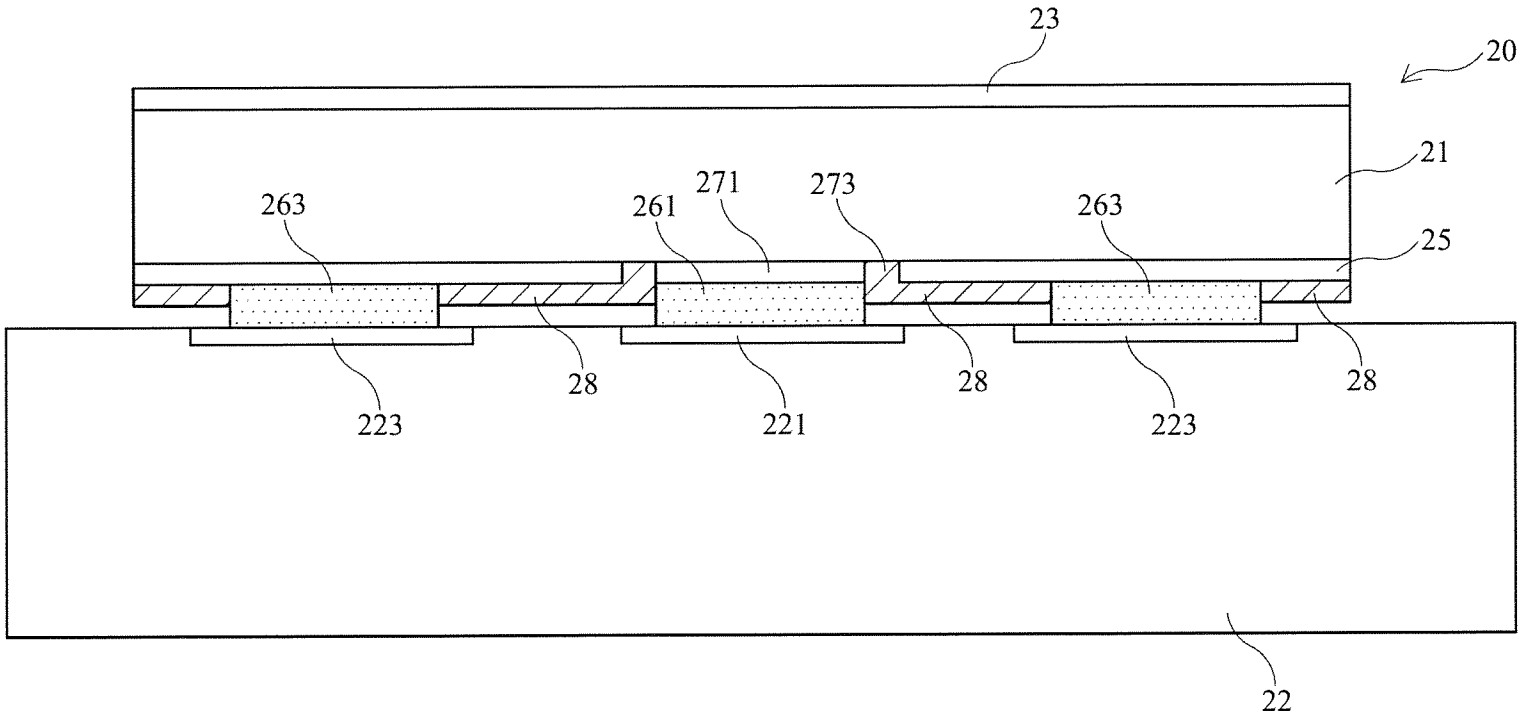
FIG. 4 is a schematic cross-sectional view illustrating an application example of the microstrip antenna in accordance with an embodiment of the present invention.
Figure 5:
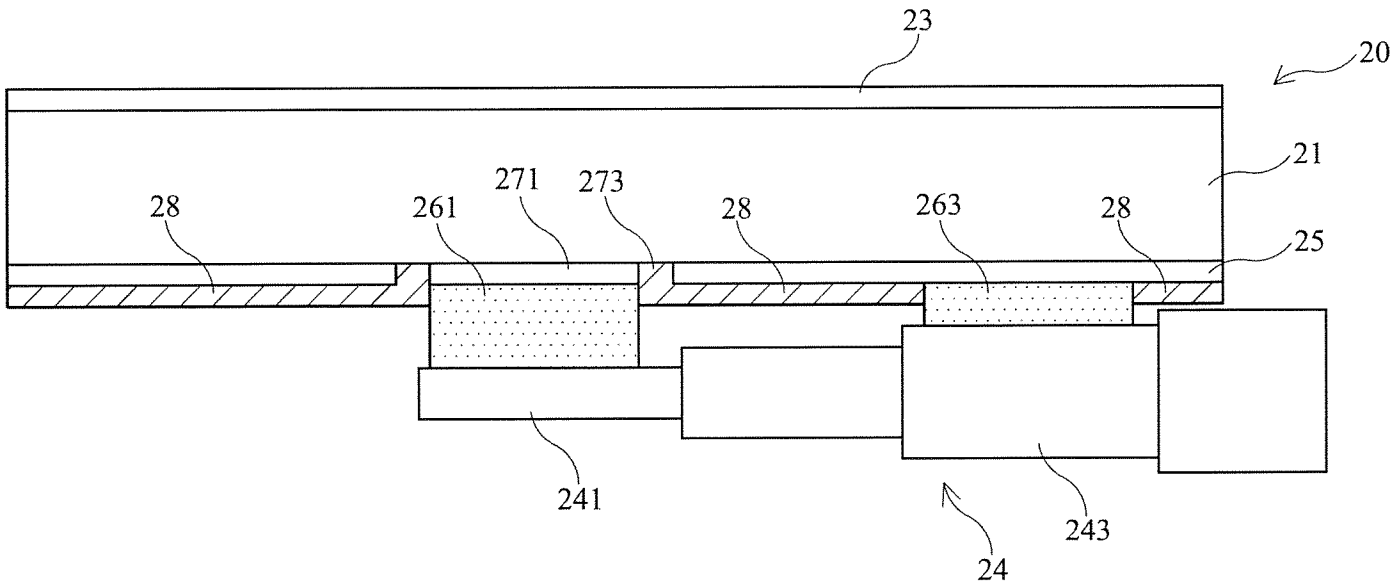
FIG. 5 is a schematic cross-sectional view illustrating another application example of the microstrip antenna in accordance with an embodiment of the present invention.

Referring to FIG. 4 and FIG. 5, the microstrip antenna 20 can be electrically connected to a circuit board 22, or a coaxial cable 24. In one embodiment, the signal feed-in terminal 221/241 of the circuit board 22 or the coaxial cable 24 connect to the feed-in unit 271 by a first conductive adhesive unit 261, and the ground terminal 223/243 of the circuit board 22 or the coaxial cable 24 connect to the second conducting layer 25 by a second conductive adhesive unit 263.

Further, an insulating material 28 can be disposed on the isolation zone 273 and portion of the second conducting layer 25 at which no second adhesive unit 263 is installed to protect the microstrip antenna 20 and to facilitate easier connection establishment between the microstrip antenna 20 and the circuit board 22 or coaxial cable 24.

Figure 6:
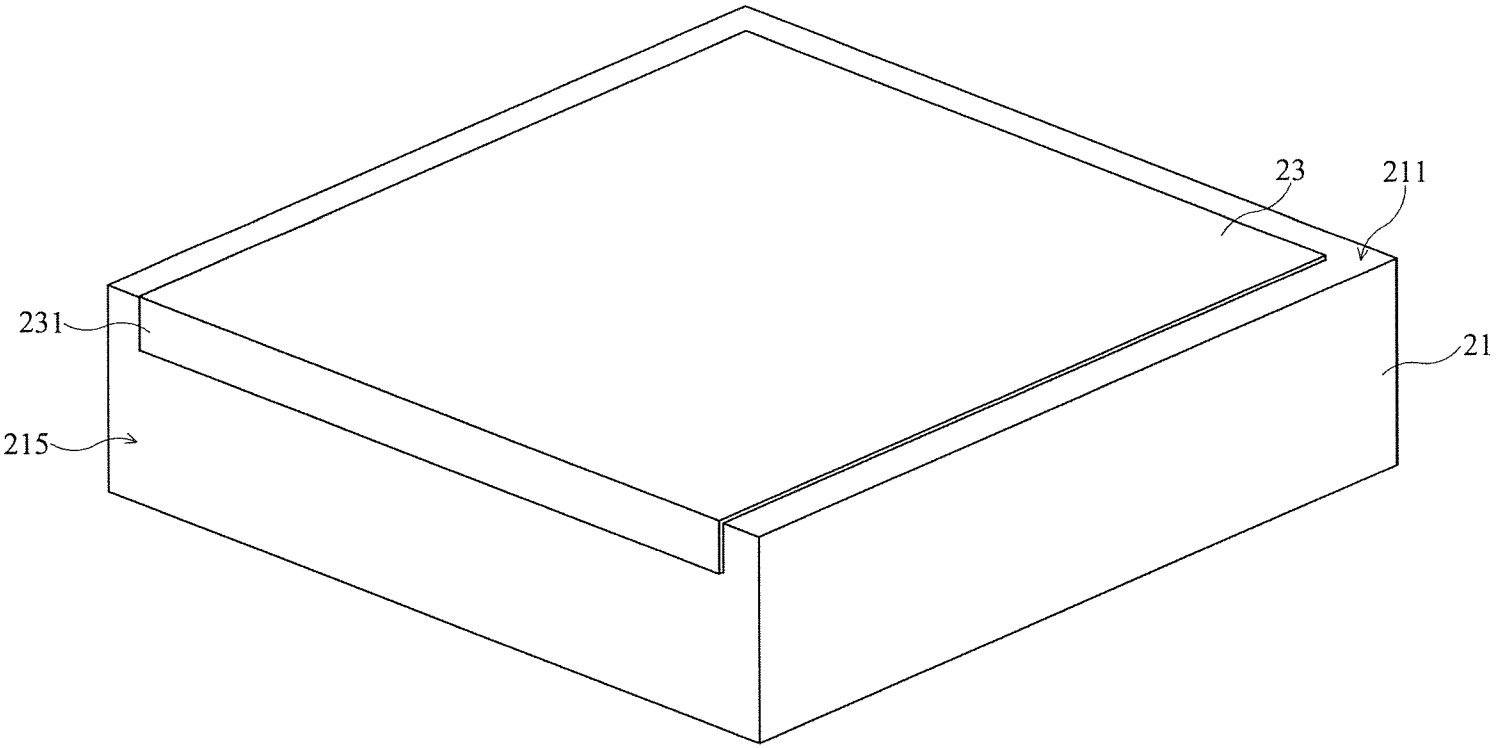
FIG. 6 is a schematic top view of an alternate form of the microstrip antenna in accordance with an embodiment of the present invention.

Referring to FIG. 6, one embodiment of the microstrip antenna in accordance with the present invention is shown. According to this embodiment, the first conducting layer 23 comprises at least one extension portion 231 located at at least one peripheral side surface 215 of the insulating substrate 21. The at least one extension portion 231 extends from the first surface 211 of the insulating substrate 21 to at least one peripheral side surface 215 of the insulating substrate 21 without connecting the second conducting layer 25.

Figure 7:
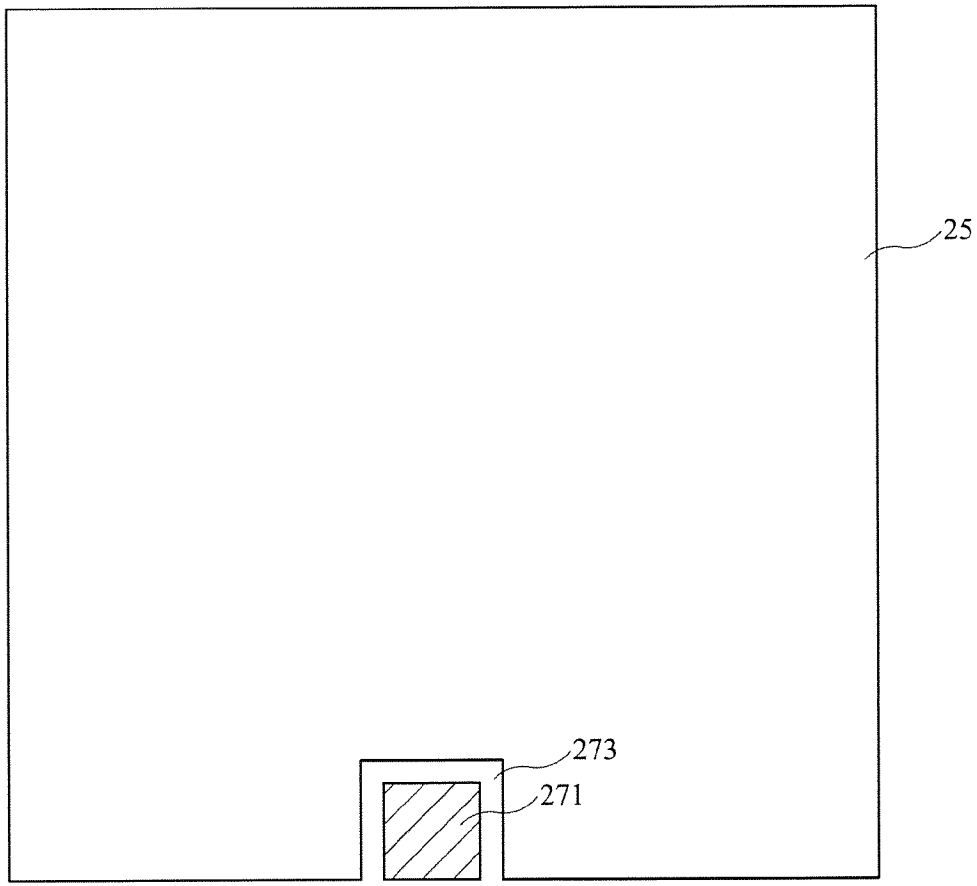
FIG. 7 is a schematic bottom view of the microstrip antenna in accordance with an embodiment of the present invention.
Figure 8:
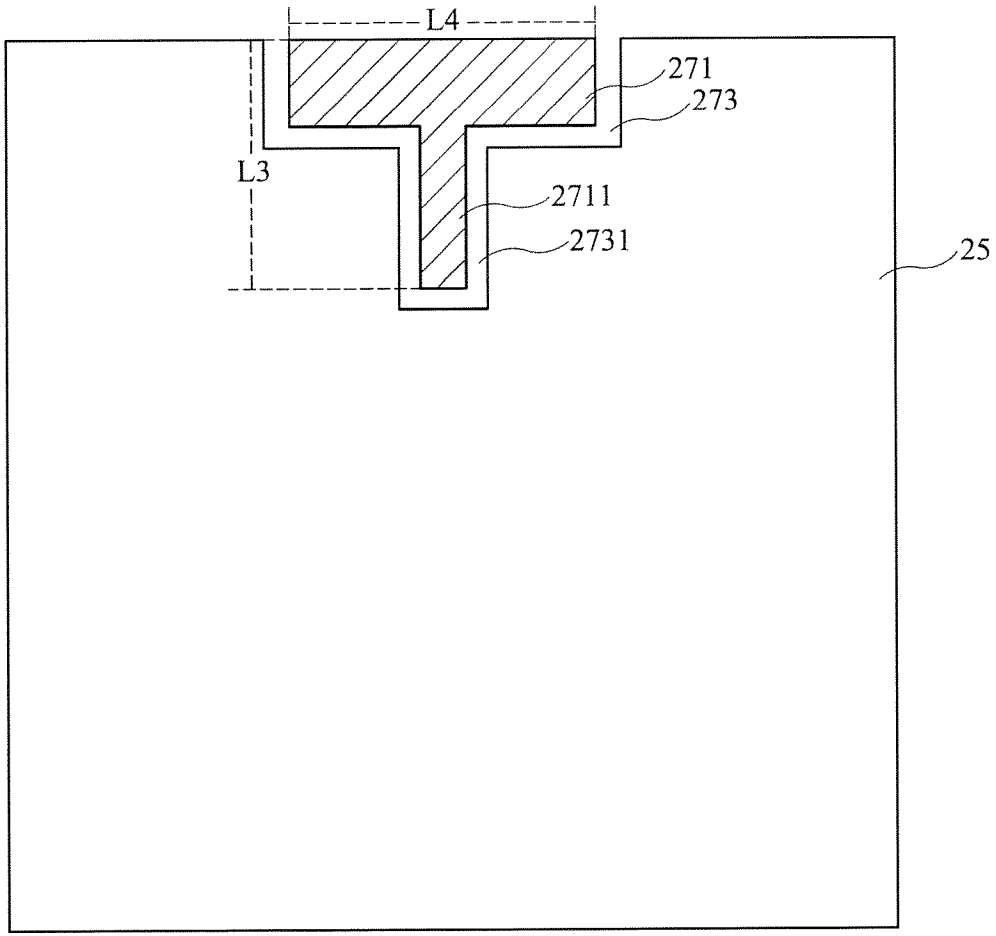
FIG. 8 is a schematic bottom view of a microstrip antenna in accordance with an embodiment of the present invention.
Figure 9:
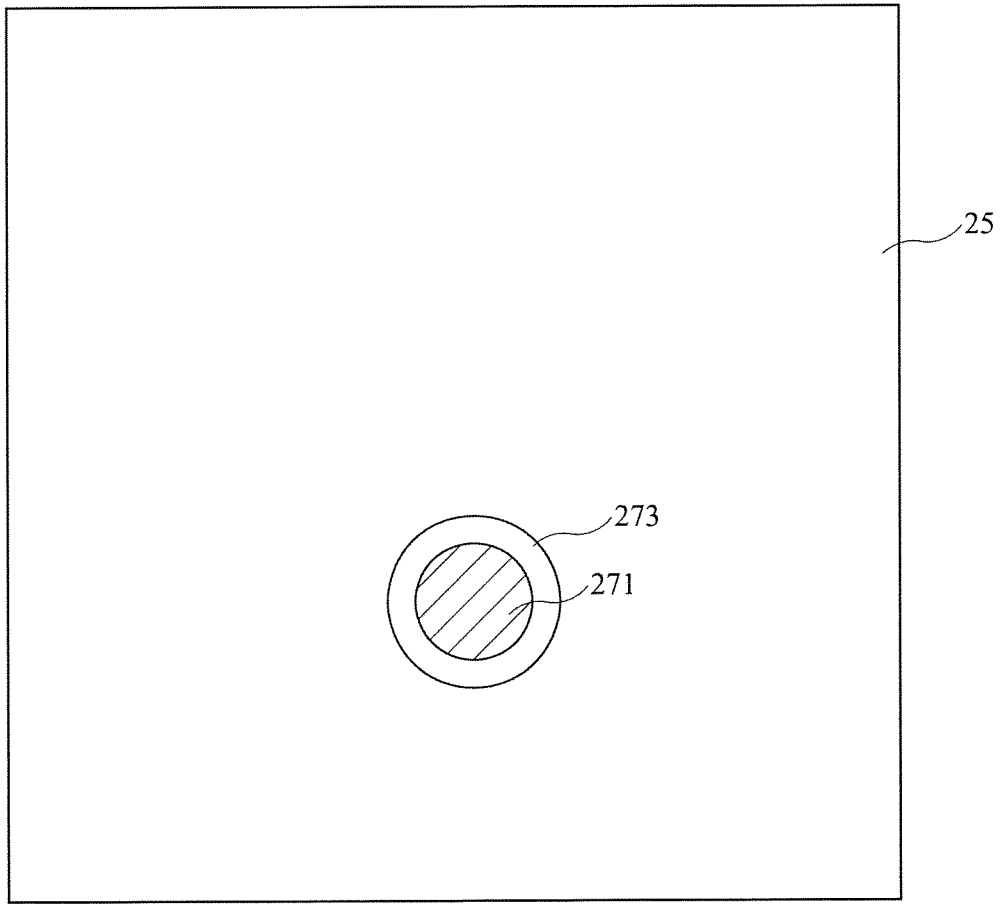
FIG. 9 is a schematic bottom view of still another microstrip antenna in accordance with an embodiment of the present invention.
Figure 10:
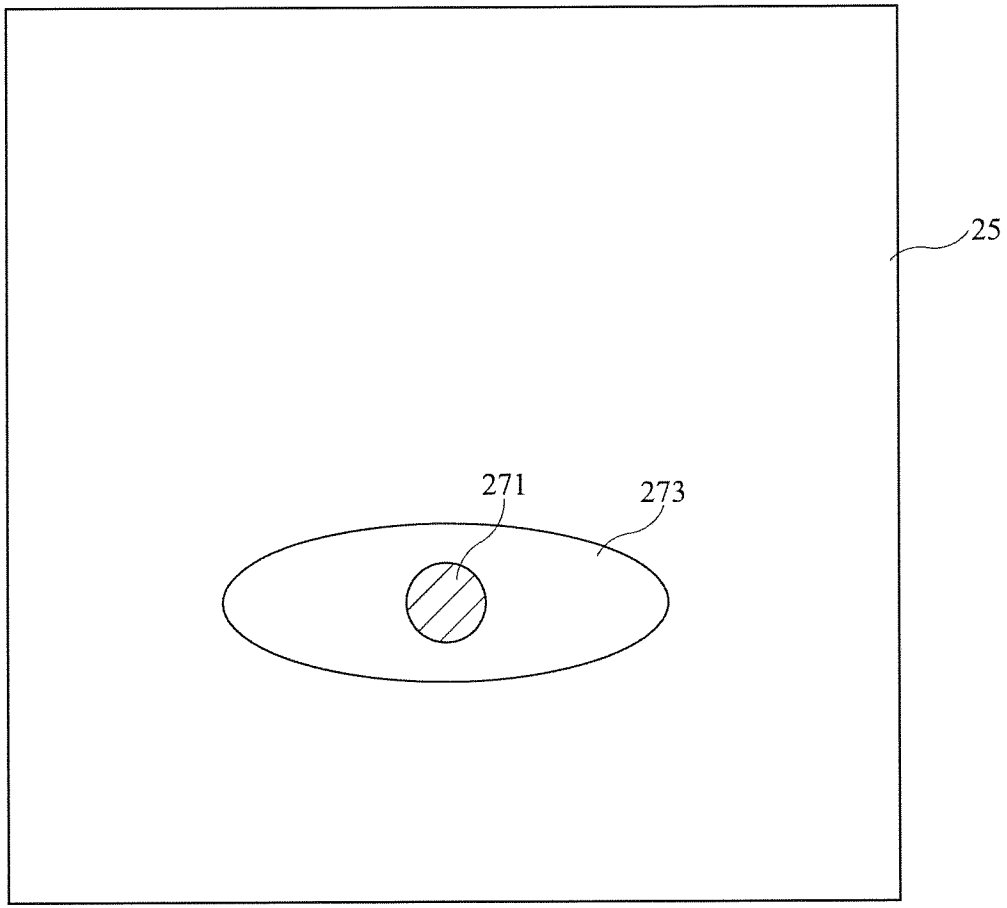
FIG. 10 is a schematic bottom view of still another microstrip antenna in accordance with an embodiment of the present invention.

Further, the aforesaid feed-in unit 271 and isolation zone 273 can be located within the second conducting layer 25, as shown in FIG. 2B and FIG. 2C. Alternatively, the feed-in unit 271 and the isolation zone 273 can be located along the edge or in a peripheral area of the second conducting layer 25, as shown in FIG. 7 and FIG. 8.

Further, the isolation zone 273 can be configured in a rectangular, circular, oval or polygon shape, or any other geometric shape, as shown in FIG. 7, FIG. 9, FIG. 10 and FIG. 11. Further, the isolation zone 273 can be configured in a multilateral shape, as shown in FIG. 12 and FIG. 13. Further, the isolation zone 273 can be configured to provide at least one protruding branch 2731, as shown in FIG. 8, FIG. 12, FIG. 13 and FIG. 15.

Figure 11:
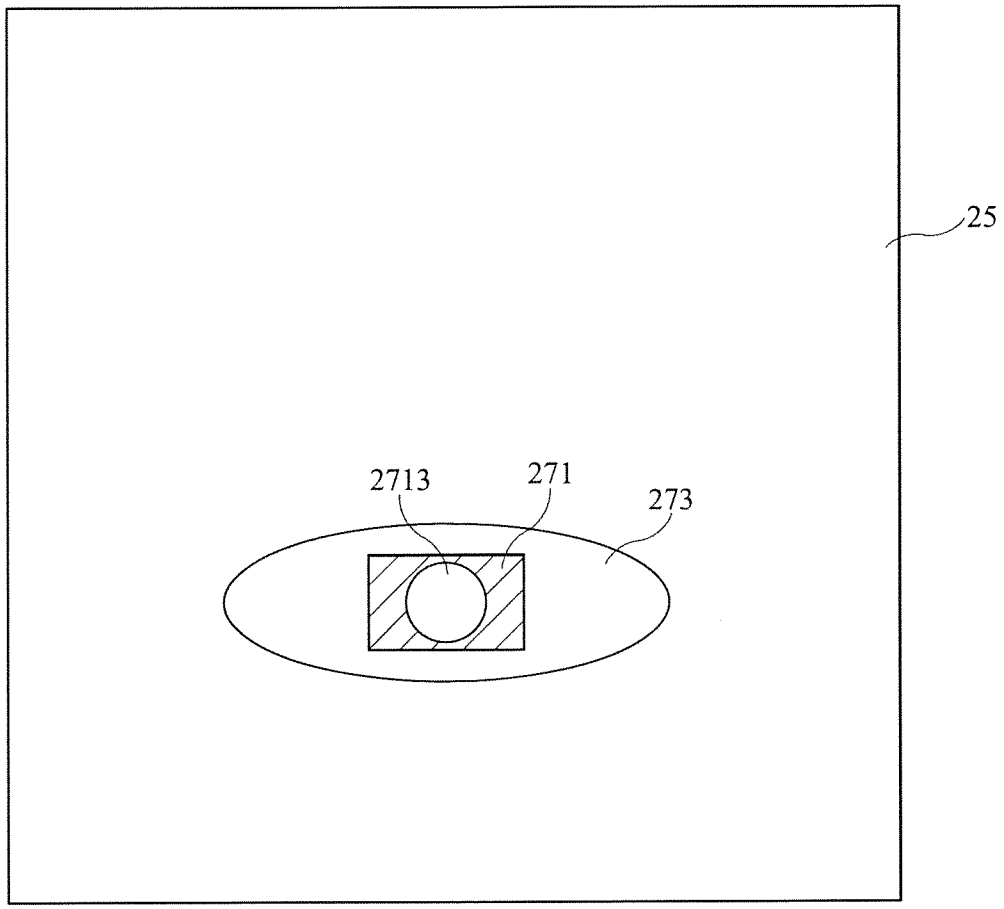
FIG. 11 is a schematic bottom view of still another microstrip antenna in accordance with the present invention.
Figure 12:
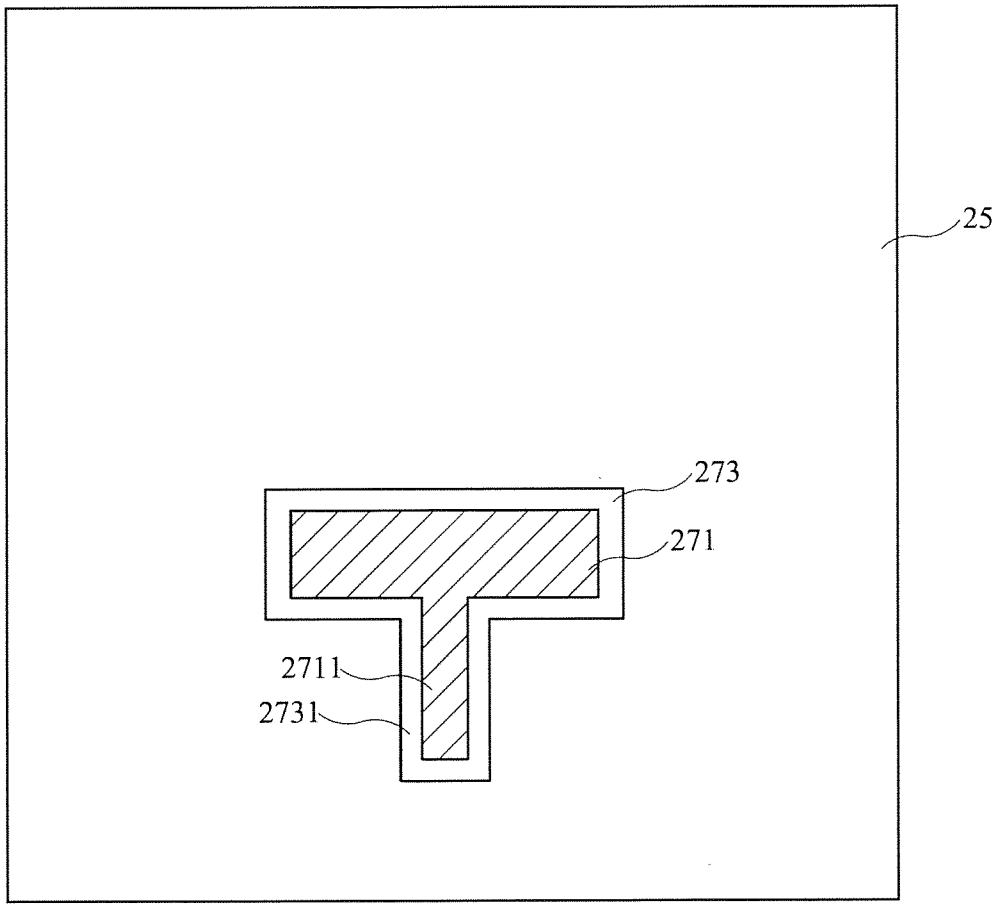
FIG. 12 is a schematic bottom view of still another microstrip antenna in accordance with an embodiment of the present invention.
Figure 13:
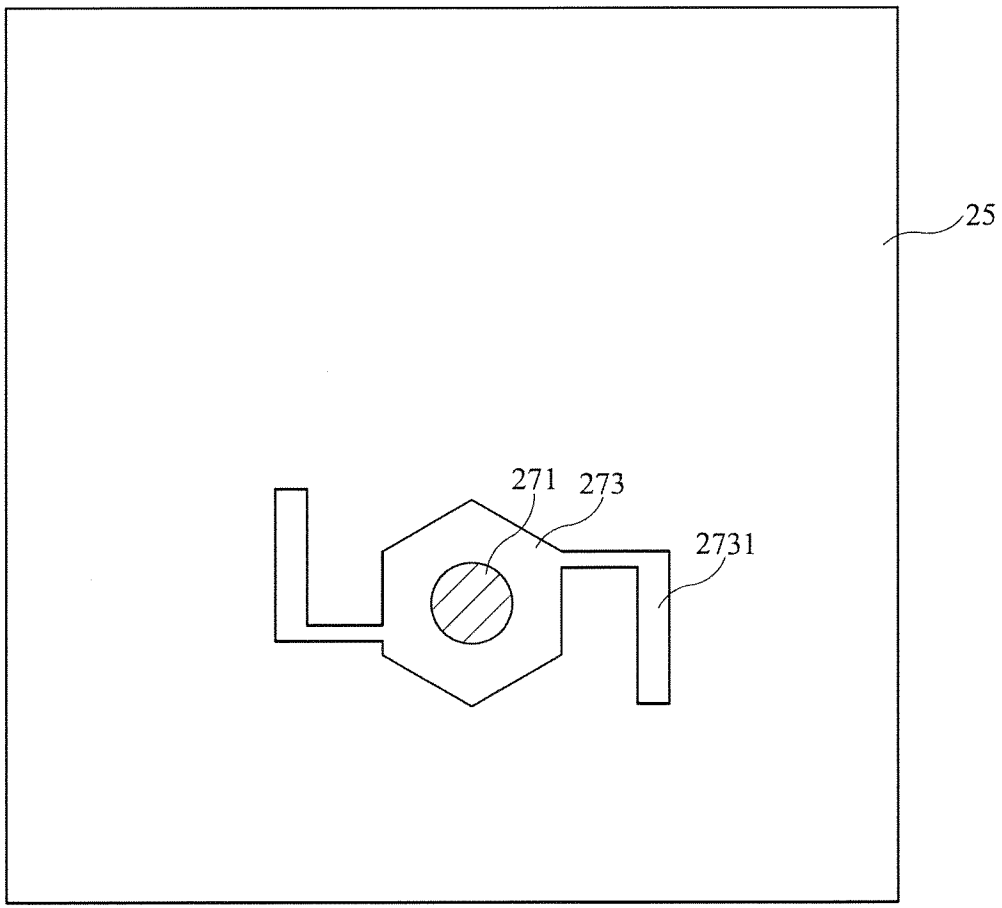
FIG. 13 is a schematic bottom view of still another microstrip antenna in accordance with an embodiment of the present invention.
Figure 14:
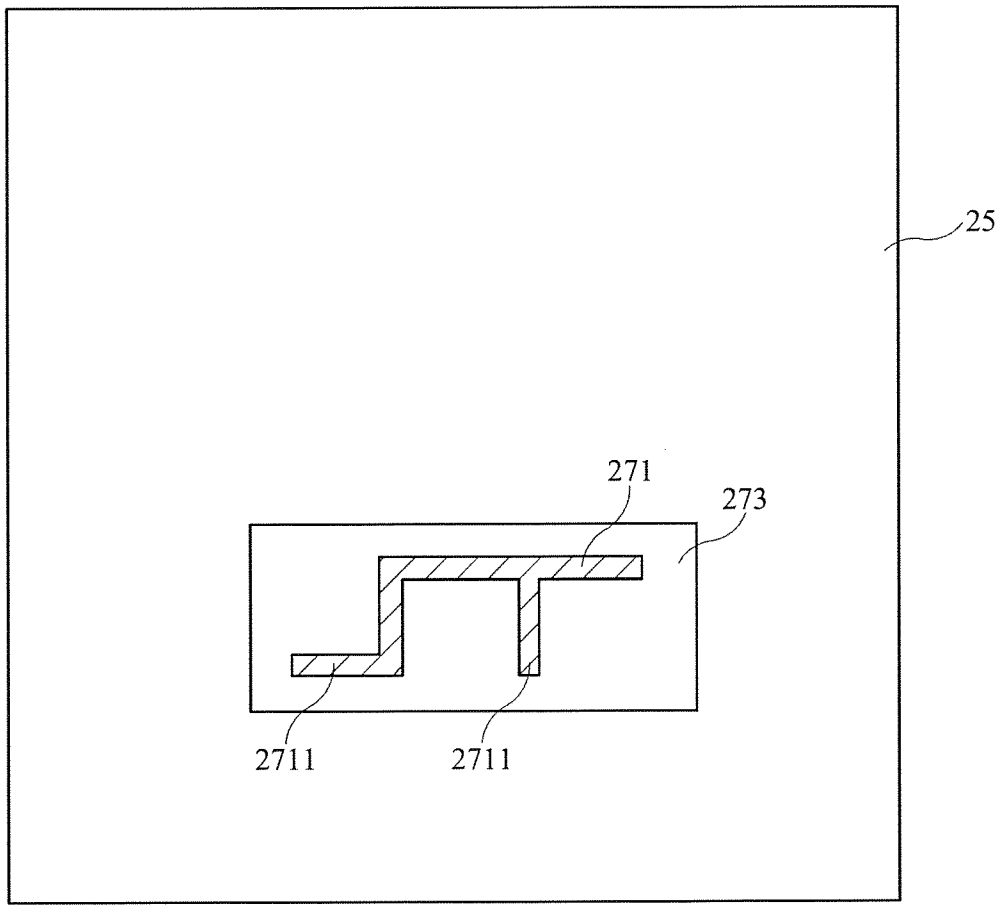
FIG. 14 is a schematic bottom view of still another microstrip antenna in accordance with an embodiment of the present invention.
Figure 15:
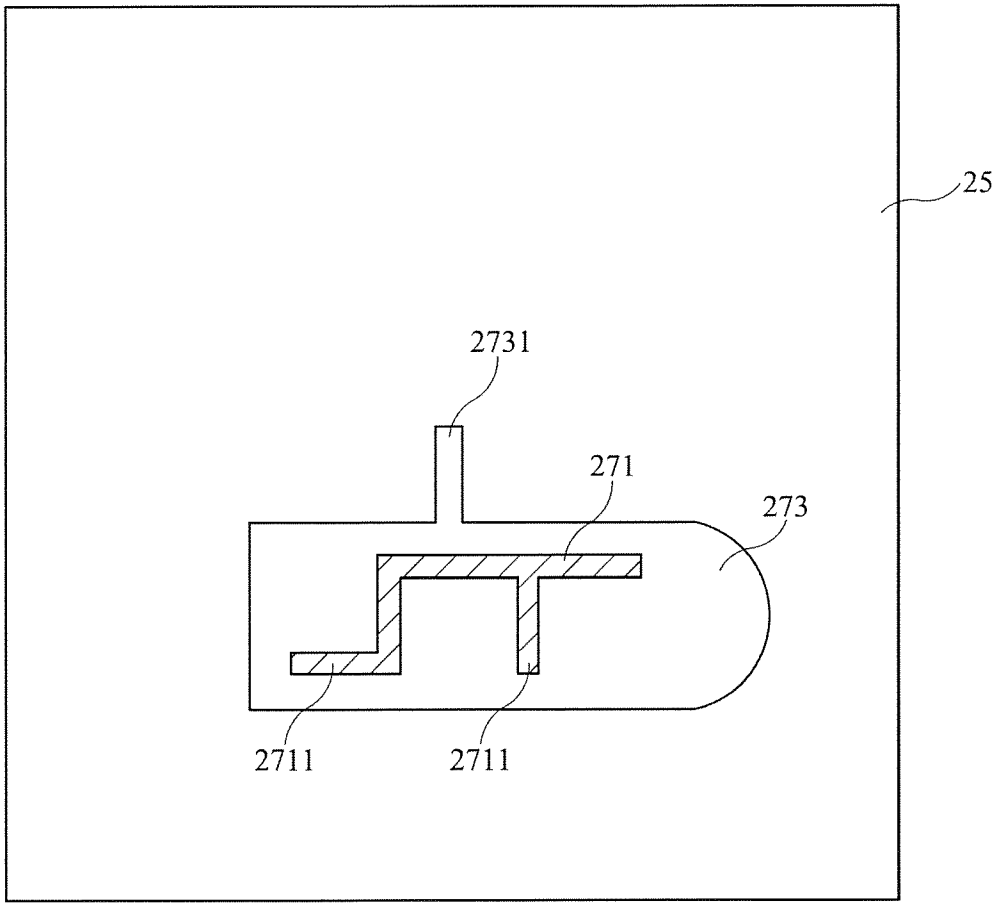
FIG. 15 is a schematic bottom view of still another microstrip antenna in accordance with an embodiment of the present invention.

Further, the feed-in unit 271 in the isolation zone 273 can be configured confirming to the shape of the isolation zone 273, as shown in FIG. 7, FIG. 8, FIG. 9 and FIG. 12, or otherwise different from the shape of the isolation zone 273, as shown in FIG. 10, FIG. 11, FIG. 13, FIG. 14 and FIG. 15. Further, the feed-in unit 271 can be configured in a rectangular, circular, oval or polygon shape, as shown in FIG. 7, FIG. 9, FIG. 10, FIG. 11 and FIG. 13. Alternatively, the feed-in unit 271 can be configured in a multilateral shape or any geometric shape, as shown in FIG. 8, FIG. 12, FIG. 14 and FIG. 15. In different embodiments of the present invention, the feed-in unit 271 can be configured to provide at least one protruding branch 2711, as shown in FIG. 8, FIG. 12, FIG. 14 and FIG. 15, or in a ring shape or hollow geometric shape with a cut-away region 2713 defined therein, as shown in FIG. 11.

Further, the feed-in unit 271 of the microstrip antenna 20 can be configured to provide at least one protruding branch 2711. By means of changing the size or shape of the at least one protruding branch 2711, or adjusting the angular between the at least one protruding branch 2711 and the rest of the feed-in unit 271, the polarization characteristics of the microstrip antenna 20 can be fine tuned. The microstrip antenna can be circularly polarized or linearly polarized.

Figure 16:
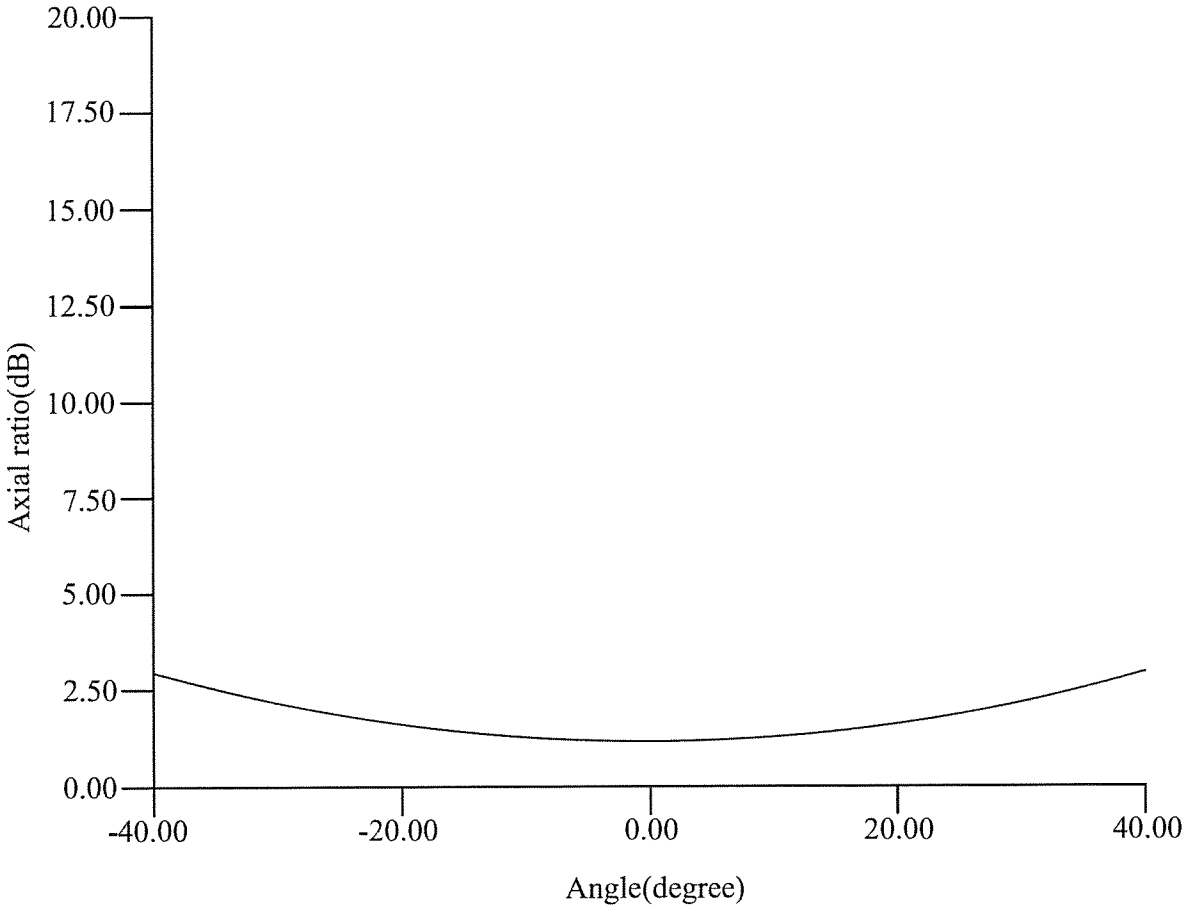
FIG. 16 is an axial ratio vs angle diagram of the microstrip antenna in accordance with an embodiment of the present invention.

In one embodiment of the present invention, as shown in FIG. 8, the feed-in unit 271 comprises a narrow elongated protruding branch 2711 perpendicularly extended from the bottom base thereof, wherein the height of the bottom base plus protruding branch L3 is about 8.5 mm; the length of bottom base L4 is about 8 mm; the width of the protruding branch 2711 and the width of the bottom base are 1 mm. Thus, the microstrip antenna 20 yields a circularly polarized characteristic. Referring also to FIG. 16, a diagram of axial ratio vs angle of the microstrip antenna 20 is shown, wherein the angle in the zenith direction right above the first conducting layer 23 is 0°, and the axial ratio of the microstrip antenna 20 is smaller than 3, i.e., the microstrip antenna 20 has a very good circularly polarized characteristic.

Figure 17A:
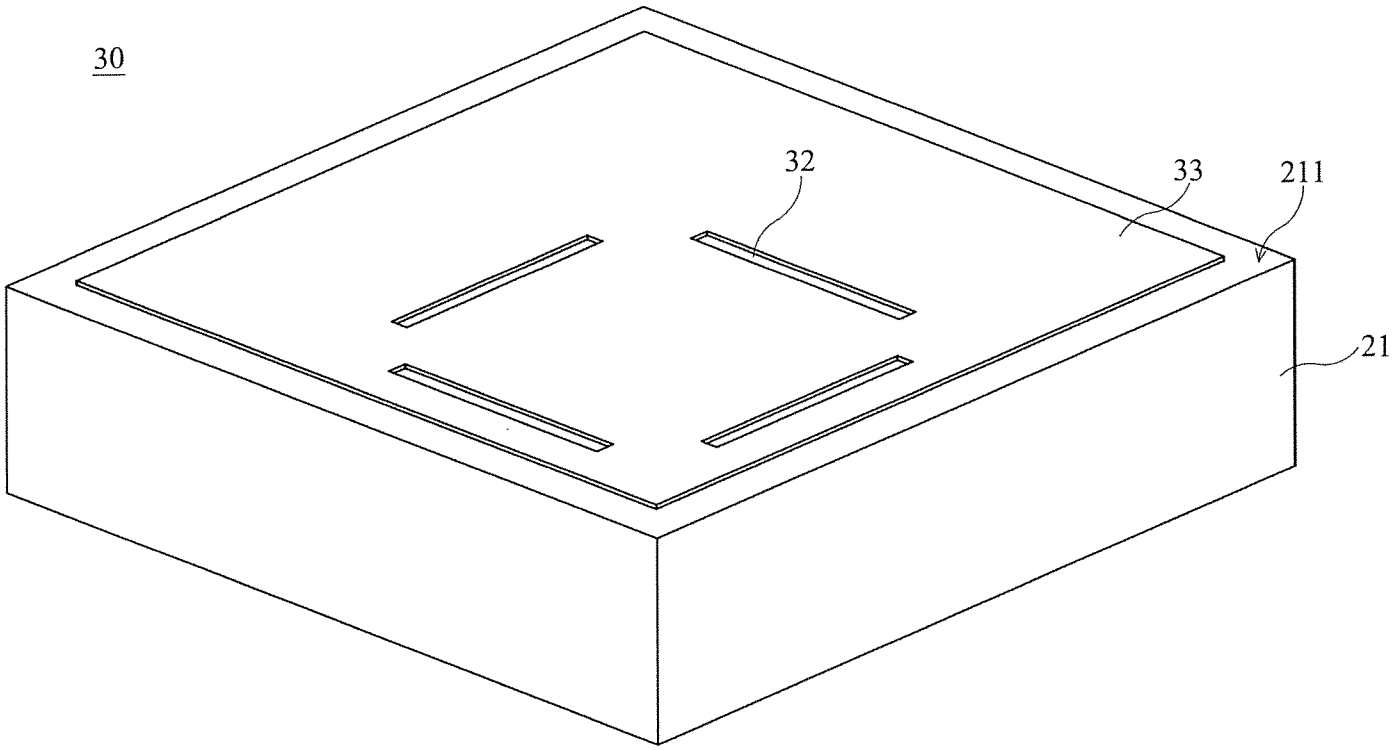
FIG. 17A is a schematic top view of still another alternate microstrip antenna in accordance with an embodiment of the present invention.
Figure 17B:
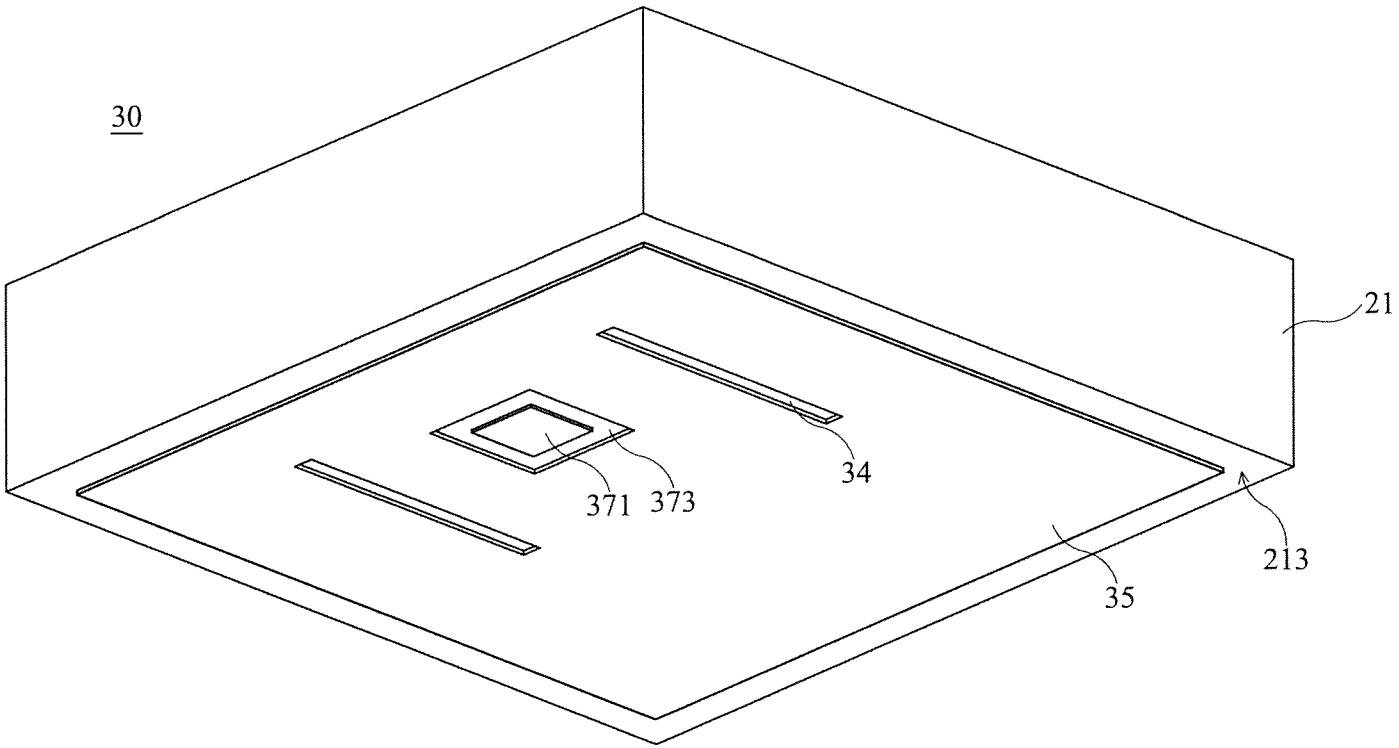
FIG. 17B is a schematic bottom view of still another microstrip antenna in accordance with an embodiment of the present invention.

Referring to FIG. 17A and FIG. 17B, schematic top and bottom views of still another embodiment of the present invention are shown. As illustrated, the microstrip antenna 30 comprises at least one insulating substrate 21, at least one first conducting layer 33, at least one second conducting layer 35, at least one first insulating unit 32, at least one second insulating unit 34, at least one feed-in unit 371, and at least one isolation zone 373.

In one embodiment, the first conducting layer 33 is located at the first surface 211 of the insulating substrate 21, and the second conducting layer 35 is located at the second surface 213 of the insulating substrate 21, wherein the first conducting layer 33 and the second conducting layer 35 are opposite to each other. The second conducting layer 35 has at least one isolation zone 373 disposed therein, wherein the at least one isolation zone 373 is a non-conductive area within the second conducting layer 35. The feed-in unit 371 is located on the second surface 213 of the insulating substrate 21 within the at least one isolation zone 373 of the second conducting layer 35, wherein the at least one isolation zone 373 separates the feed-in unit 371 from the second conducting layer 35.

Further, in one embodiment of the present invention, at least one first insulating unit 32 is located within the first conducting layer 33, wherein the at least one first insulating unit 32 is a non-conductive area within the first conducting layer 33. In another embodiment of the present invention, at least one second insulating unit 34 is located within the second conducting layer 35, wherein the at least one second insulating unit 34 is a non-conductive area within the second conducting layer 35, and the second insulating unit 34 can be located between the isolation zone 373 and the side lines of the second conducting layer 35.

In actual application, first insulating unit 32 and second insulating unit 34 can be respectively installed at the same in the first surface 211 and second surface 213 of the insulating substrate 21 of the microstrip antenna 30. Alternatively, the microstrip antenna 30 can be configured having only first insulating unit 32 located on the first surface 211 of the insulating substrate 21, or only second insulating unit 34 located on the second surface 213 of the insulating substrate 21.

The first insulating unit 32 and the second insulating unit 34 are non-conductive areas respectively located within the first conducting layer 33 and the second conducting layer 35, and respectively configured in the form of cut-away regions in the first conducting layer 33 and the second conducting layer 35. Because electric current at the first conducting layer 33 and/or the second conducting layer 35 cannot go through the first insulating unit 32 and/or the second insulating unit 34, the arrangement of the first insulating unit 32 and/or the second insulating unit 34 increases the path length of the signal current at the first conducting layer 33 and/or the second conducting layer 35, and therefore lowers the resonant frequency of the microstrip antenna 30.

In various embodiments of the present invention, arranging a number of first insulating units 32 and/or second insulating units 34 in the first conducting layer 33 and/or the second conducting layer 35 can lower the resonant frequency of the microstrip antenna 30 without the need of increasing the dimensions the first conducting layer 33 and/or the second conducting layer 35 and hence the dimensions of insulating substrate 21 do not need to be increased.

Further, in the various embodiments of the present invention, lowering the resonant frequency of the microstrip antenna 30 does not need to use insulating substrate 21 with a higher dielectric constant. In other words, during fabrication of the microstrip antenna 30, the manufacturer can produce a large quantity of microstrip antenna in the same size and with the same material, and can fine-tune the resonant frequency of the microstrip antenna 30 by means of introducing at least one first insulating unit 32 and/or at least one second insulating unit 34 in the first conducting layer 33 and/or the second conducting layer 35, thereby significantly reducing the microstrip antenna 30 manufacturing cost.

Figure 18:
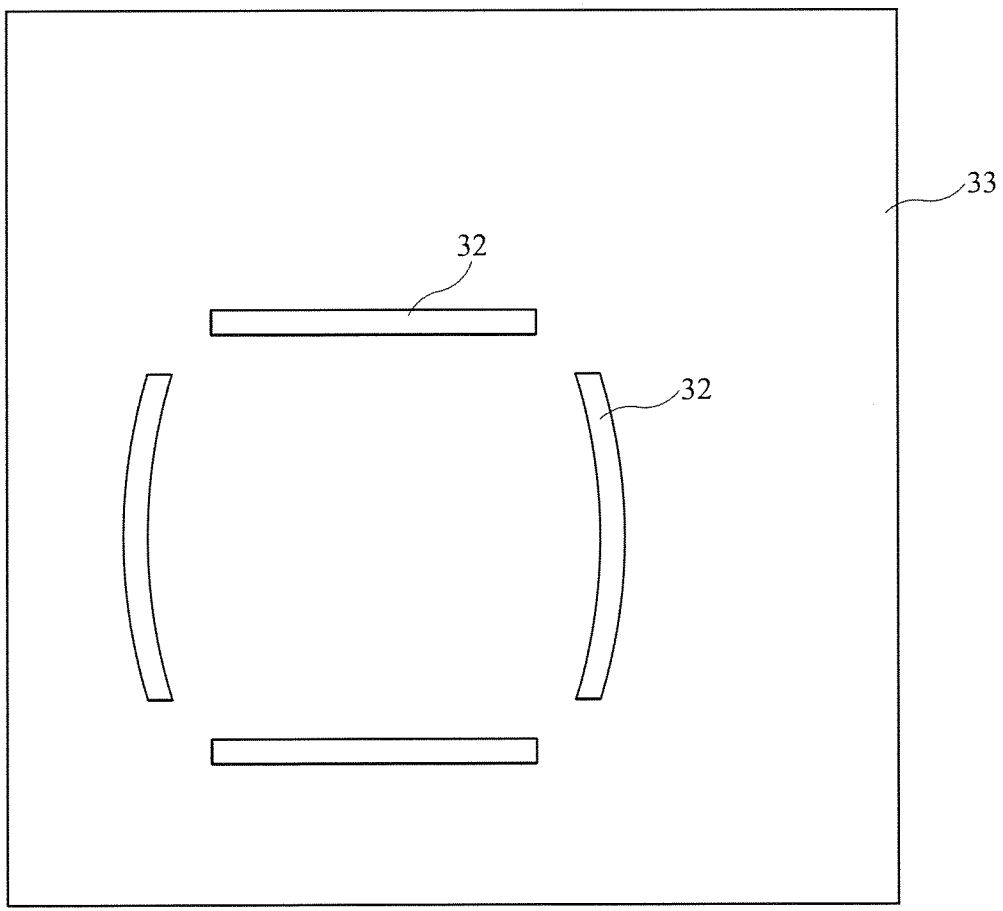
FIG. 18 is a top view of still another microstrip antenna in accordance with an embodiment of the present invention.
Figure 19:
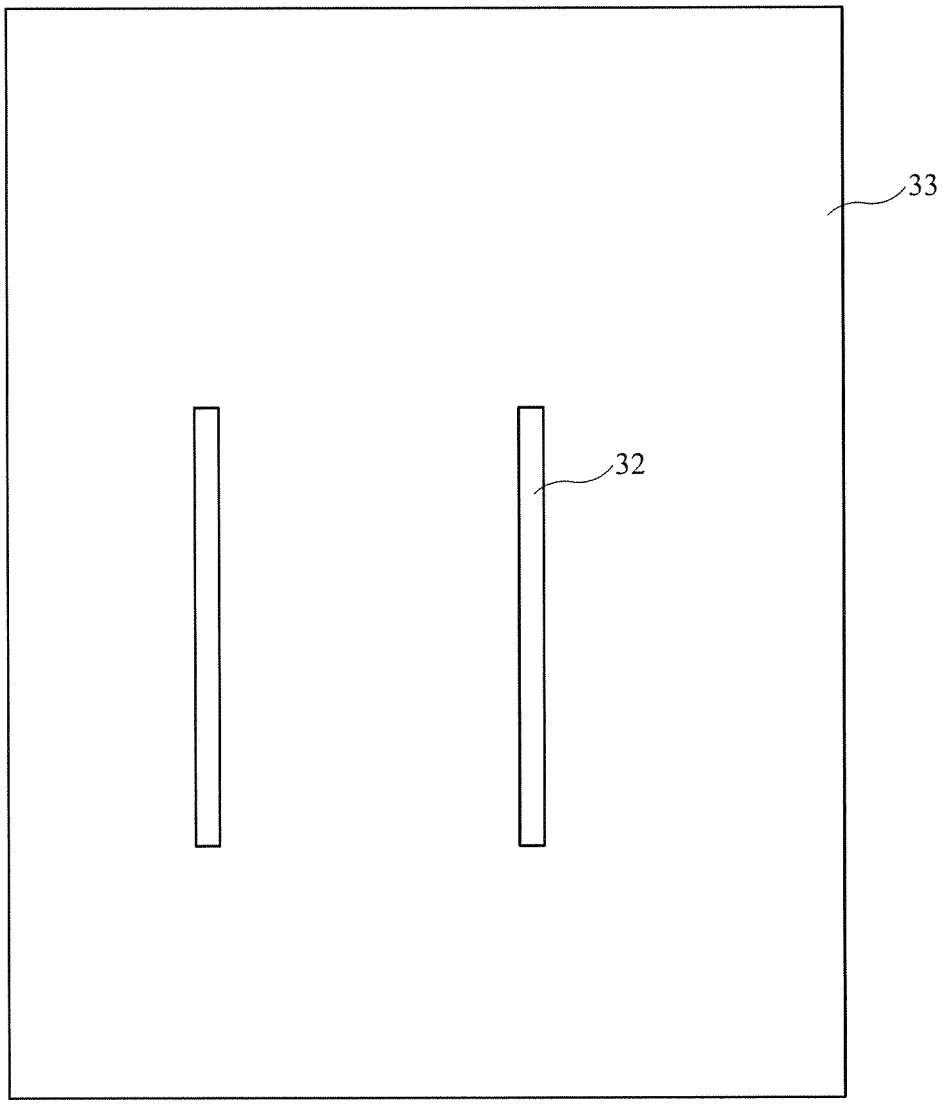
FIG. 19 is a top view of still another microstrip antenna in accordance with an embodiment of the present invention.
Figure 20:
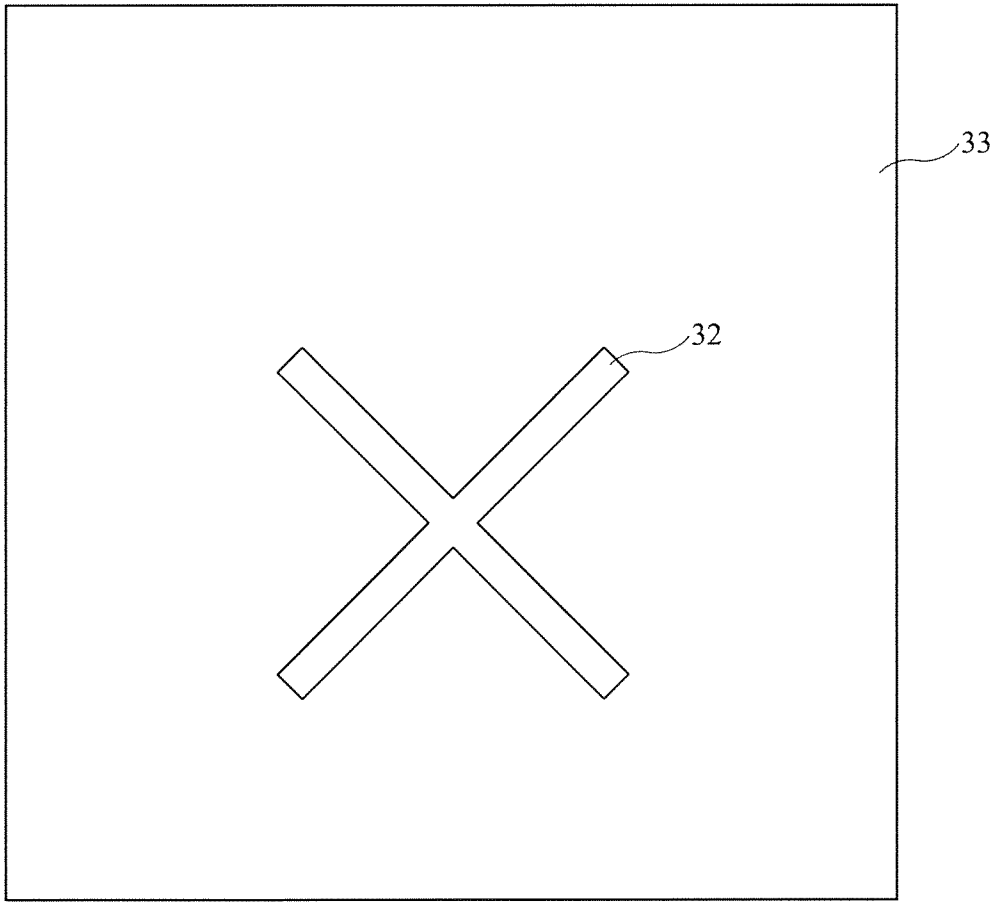
FIG. 20 is a top view of still another microstrip antenna in accordance with an embodiment of the present invention.

Further, the shape of the first insulating unit 32 can be configured as circular, elliptic, rectangular, polygon, curved rectangular, curved elliptic, arch, irregular arch, geometric shape having at least three branches, X-shape, or any other geometric shape, as shown in FIG. 18, FIG. 19 and FIG. 20. Further, the shape of the second insulating unit 34 can be configured as circular, elliptic, rectangular, polygon, curved rectangular, curved elliptic, arch, irregular arch, geometric shape having at least three branches, X-shape, or any other geometric shape.

It is to be understood the invention is not limited to particular systems described which may, of course, vary. It is also to be understood that the terminology used herein is for the purpose of describing particular embodiments only, and is not intended to be limiting. As used in the present invention, the singular forms "a", "an" and "the" include plural referents unless the content clearly indicates otherwise. Thus, for example, reference to "a device" includes a combination of two or more devices and reference to "a material" includes mixtures of materials.

Further modifications and alternative embodiments of various aspects of the present invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A microstrip antenna for receiving and transmitting of radio frequency signals, comprising:

an insulating substrate comprising a first surface and a second surface, said first surface and said second surface being disposed opposite to each other;

at least one first conducting layer disposed on said first surface of said insulating substrate;

at least one second conducting layer disposed on said second surface of said insulating substrate, each said second conducting layer comprising at least one isolation zone, each said isolation zone being a non-conductive area within said second conducting layer;

at least one feed-in unit disposed on said second surface of said insulating substrate and within said isolation zone of said second conducting layer for coupling a signal feed-in terminal, wherein said isolation zone is adapted to separate said feed-in unit from said second conducting layer and said feed-in unit establishes an electric connection with said first conducting layer by electromagnetic coupling across said insulating substrate;

a first resonant frequency and a second resonant frequency, wherein said first resonant frequency and said second resonant frequency are related to the side lengths and diagonal lengths of said first conducting layer, and said first resonant frequency and second resonant frequency are tuned by changing the side lengths and diagonal lengths of said first conducting layer; and a third resonant frequency, wherein said third resonant frequency is determined by the circumference length of said isolation zone within said second conducting layer on said second surface.

2. The microstrip antenna as claimed in claim 1, wherein said first conducting layer comprises at least one extension portion disposed at at least one peripheral side surface of said insulating substrate so that said first conducting layer extends from said first surface of said insulating substrate to said at least one peripheral side surface.

3. The microstrip antenna as claimed in claim 1, wherein the shape of said isolation zone is configured as rectangular, circular, oval, polygon, multilateral, any other geometric shape, or any other geometric shape with at least one protruding branch.

4. The microstrip antenna as claimed in claim 1, wherein said feed-in unit wholly or at least partially overlaps said first conducting layer.

5. The microstrip antenna as claimed in claim 1, wherein the shape of said feed-in unit is configured as rectangular, circular, oval, polygon, multilateral, ring-like hollow geometric shapes, or any other geometric shape.

6. The microstrip antenna as claimed in claim 1, wherein said feed-in unit comprises at least one protruding branch, the size and shape of said protruding branch as well as the angle between said protruding branch and the rest of said feed-in unit determine the circular polarization characteristics of said microstrip antenna.

7. The microstrip antenna as claimed in claim 1, wherein said feed-in unit and said second conducting layer are electrically connected respectively to signal feeding terminal and ground terminal of a circuit board or a coaxial cable.

8. The microstrip antenna as claimed in claim 1, further comprising at least one first insulating unit disposed within said first conducting layer, wherein said first insulating unit being a non-conductive area on said first surface.

9. The microstrip antenna as claimed in claim 8, wherein the shape of said first insulating unit is configured as circular, elliptic, rectangular, polygon, curved rectangular, curved elliptic, arch, irregular arch, geometric shape having at least three branches, X-shape, or any other geometric shape.

10. The microstrip antenna as claimed in claim 1, further comprising at least one second insulating unit disposed within said second conducting layer, wherein said second insulating unit being a non-conductive area on said second surface.

11. The microstrip antenna as claimed in claim 10, wherein the shape of said second insulating unit is configured as circular, elliptic, rectangular, polygon, curved rectangular, curved elliptic, arch, irregular arch, geometric shape having at least three branches, X-shape, or any other geometric shape.

12. The microstrip antenna as claimed in claim 1, wherein said feed-in unit and said isolation zone are located along the edge or peripheral area of said second conducting layer.

* * * * *